US006581338B2

(12) United States Patent
Koenig et al.

(10) Patent No.: US 6,581,338 B2
(45) Date of Patent: Jun. 24, 2003

(54) ESCAPABLE AREA WELL COVER

(76) Inventors: Myron N. Koenig, 47587 Highway 55, Brooten, Stearns, MN (US) 56316; Richard D. Lintel, 10263 Country Rd. 8 Box 129, Brooten, Pope, MN (US) 56316

( * ) Notice: Subject to any disclaimer, the term of this patent is extended or adjusted under 35 U.S.C. 154(b) by 0 days.

(21) Appl. No.: 10/066,219

(22) Filed: Oct. 20, 2001

(65) Prior Publication Data

US 2002/0100222 A1 Aug. 1, 2002

Related U.S. Application Data

(60) Provisional application No. 60/242,289, filed on Oct. 20, 2000.

(51) Int. Cl.[7] ..... E06B 5/02; E04B 1/34
(52) U.S. Cl. ..... 52/107; 52/3
(58) Field of Search ..... 52/107, 169.6, 52/3

(56) References Cited

U.S. PATENT DOCUMENTS 2,793,688 A * 5/1957 Robey
2,863,177 A * 12/1958 Nelson
3,085,489 A * 4/1963 Ivy
3,232,014 A * 2/1966 Frost
5,752,348 A * 5/1998 Pearson

* cited by examiner

*Primary Examiner*—Carl D. Friedman
*Assistant Examiner*—Kevin McDermott
(74) *Attorney, Agent, or Firm*—Albert W. Watkins

(57) ABSTRACT

An escapable area well cover includes an elevated body having a top gently sloping away from a building, and a trio of sides that extend generally vertically. A casement window is pivotal beneath the cover, and may be either right or left hinged and still fully opened. The cover additionally includes a pair of flanges adjacent the building that permit the cover to conform to irregular building surfaces while also increasing the strength of the cover. A second pair of flanges cooperates with the top of the area well, to both support the cover and also shed moisture away from the area well. The cover is most preferably fabricated from an ultraviolet resistant plastic such as UV protected polycarbonate, and may be formed by many different techniques, but is most preferably vacuum thermoformed.

16 Claims, 3 Drawing Sheets

ESCAPABLE AREA WELL COVER

This application claims priority to U.S. Provisional Application serial No. 60/242,289 filed Oct. 20, 2000, the contents which are incorporated herein by reference in entirety.

BACKGROUND OF THE INVENTION

1. Field of the Invention

This invention pertains generally to subterranean rooms or building structures that require human access in the event of an emergency, and more specifically to area well covers suitable for use with windows of the egress type that have an adjacent area window well which must remain accessible from either direction in the event of an emergency.

2. Description of the Related Art

As human civilization has advanced through the ages, there has been a developing awareness of the need for safety in building structures in order to preserve human life. The desire to preserve life has led to improvements in many areas, including the implementation of standard building codes that regulate electrical wiring, plumbing and even access routes into and from various rooms.

The need to regulate access routes has stemmed from the otherwise needless loss of life that has occurred when fire blocks a single access route. Fires may travel down common pathways such as hallways and the like with little impediment. In such a situation, a person who is otherwise fully capable of movement may not have the opportunity to leave a room or area unless another exit pathway is available. In such an instance, it is highly desirable for an occupant to have an alternative passageway, such as through a window or doorway to the ground level. For ground level rooms, this is normal construction. Nearly all ground level rooms have an entrance through a hallway or the like, and an exit through some type of window or doorway. However, subterranean structures, such as basements and lower levels within homes do not always have sufficient ground clearance for an ordinary window or door access portal.

In order to meet the need for subterranean access to and from the building exterior, specially designed windows, referred to in the trade as egress windows, have been designed. Egress windows permit the emergency evacuation of a partially or completely subterranean room in the event other access pathways are blocked. Wells are provided in the ground adjacent each window which enable the window to admit both light and air, and open fully to permit evacuation through the window opening. The window wells, which may extend three or more feet below the surface of the ground, are typically shored with corrugated steel reinforced walls imbedded in the ground and attached to the building wall adjacent the window.

These egress windows are most preferably designed to enable access from both directions. In other words, a person otherwise trapped within a room may exit the room through the egress window. Additionally, a firefighter or other emergency personnel may gain access to the room by entering through the egress window. With this dual directionality of the egress windows, building codes have been adopted that require the windows to be sufficiently large to permit a firefighter to enter through the window with an air tank or the like. Consequently, the size of an area window well has become relatively large.

In the warmer and more arid climates, egress windows generally perform satisfactorily throughout the year, and with little maintenance. Furthermore, in these climates, the size of the area window well is generally of little consequence. However, in climates where there are a preponderance of trees, leaves tend to accumulate within the area well. Leaves tend to conceal other more serious obstacles, such as sticks or other objects which may prevent the egress window from opening sufficiently to permit safe passage therethrough. Consequently, even a seemingly harmless accumulation of leaves within an area window well can ultimately lead to the unnecessary loss of life. In more northern climates, particularly where snow and ice accumulate through the winter months, additional problems have been encountered with area wells. Where snow and ice accumulate, the snow may tend to fill the area well. A number of hazards result from this build-up of snow, including the risk of the snow or ice blocking the egress window from opening. In such a situation, the window can no longer fulfill the function of safe passage.

With a large area window well, another hazard is created. Both humans and animals that are passing near the building structure may accidentally fall into it. While this is an unlikely event by day when the ground is clear, the risk is much greater at night or when natural coverings such as leaves or snow accumulate. All too frequently, homeowners have had the unpleasant experience of a skunk or other wild animal accidentally falling into the area well during the night, or children playing after dark forgetting about the area window well. Similarly, when snow accumulates, it maybe impossible to even know that an area window well is present adjacent the house. There have been numerous instances of people falling through snow drifts into wells, and on occasion these people have needlessly injured themselves. Obviously, in more northern locals where the snow gets so deep to completely conceal the existence of the area window well, passage through the window may also be impossible.

In order to keep debris out of area wells, there have been proposed various well covers. One type of cover used in the prior art is a metal grating, which protects humans and animals from passing accidentally into the well. This metal grating was designed prior to the development of egress windows, and so is intended only to admit light and air and does not extend above a window such as the casement type windows. Consequently, the grating interferes with window motion where the window top extends above the top of the area well. In addition, the grating still allows smaller animals to pass through, and further allows debris, including leaves, sticks and snow to pass therethrough. Consequently, it is also still quite possible for the window to be blocked and rendered useless, even where the design would otherwise be well suited. Further limiting the use of a grating is the extreme difficulty for an installer to accommodate irregular building surfaces. While many foundations are consistent, some have significant obstacles or variants that seriously complicate the installation of a grating.

Flat translucent plastic covers provide several advantages over the metal gratings, including lower weight and typically lower cost, admission of light, exclusion of snow and debris, and more ready modification to accommodate irregular building surfaces. These types of covers are for example illustrated by Slade in U.S. Pat. Nos. 3,048,897, 3,048,900, and 3,703,791, and also by Frost in U.S. Pat. No. 3,232,014, each which are incorporated by reference herein. In these patents, a flat or generally flat cover is used to cover a window well, and various clips are illustrated therein for retaining the cover to well. While these patents addressed the need to keep debris out of the older window wells, these covers are of no benefit for modem egress windows, which frequently extend above the surrounding window well top. In such instances, the Slade covers will again prevent the casement window from opening and will consequently create a hazard.

Other designs have illustrated a domed cover, and include such patents as U.S. Pat. No. 3,085,489 to Ivy; U.S. Pat. No. 3,123,868 to Gust; and U.S. Pat. No. 4,330,500 to Mackes. While these patents offer some benefits not found in the prior art, they still do not adequately address the operation of a casement type window, nor do they provide adequate means for attaching to irregular building surfaces.

SUMMARY OF THE INVENTION

In a first manifestation, the invention is an area window well cover for enclosing a generally horizontal top opening of an area window well. The cover accommodates a diverse variety of building exterior wall surfaces and geometries, including flat and smooth regular walls and also including irregular surfaces that are not flat and smooth. A body member extends generally across the top opening of the area window well. A wall flat-mount flange extends at an angle from the body member in a plane generally parallel to the building exterior wall. A modifiable wall accommodating flange extends at an angle from the wall flush-mount flange and also at an angle relative to the building exterior wall. The modifiable flange is operatively modified to accommodate a diverse variety of building exterior wall surfaces and thereby fully enclose an area window well.

In a second manifestation, the invention is an area window well cover for enclosing a top opening of an area window well located adjacent a building exterior wall. The cover allows the top of a generally planar casement window, that extends above a top of the area well, to rotate from a closed position to an open egress position underneath the cover. The cover includes a top body member which, when placed in operative position, extends generally above the window top irrespective of whether the casement window is closed, open or between. The top body member extends primarily horizontally from the building exterior wall with a gentle slope therefrom, and has a geometry that operatively accommodates movement of said casement window. The cover also has a first side body member that is adjacent each of the building exterior wall, a first edge of the top body member and the area window well, and thereby forms a generally vertically extending, substantially planar surface. A second side body member is adjacent the building exterior wall, area window well, and a second edge of the top body member distal to the first edge of the top body member, and thereby form a generally vertically extending substantially planar surface. A third side body member is adjacent the top body member, first and second side body members and the area window well, thereby forming a generally vertically extending substantially planar surface.

In a third manifestation, the invention is a method for enclosing an area window well adjacent a building surface. The method includes the steps of determining standard window well dimensions that are most closely associated with the area window well; forming an area window well cover having a dome, a first flange and a second flange to fit the standard window well dimension; trimming the second flange to fit the area window well cover adjacent building surface to thereby fully enclose the area window well; attaching a retaining clip to the area window well cover; coupling the retaining clip with area window well cover; and engaging the trimmed second flange with the building surface.

Exemplary embodiments of the present invention solve the inadequacies of prior area window well covers by providing a transparent, shaped cover that is sufficiently strong to support a person and which is readily installed and adaptable to diverse building surfaces and area wells.

OBJECTS OF THE INVENTION

A first object of the invention is the provision of a cover which improves safety of an area well and egress window. Animals, persons, snow and debris will most preferably be prevented from unintentionally entering the area well, while the area well cover will most desirably be removable from the inside of the area well or from the outside of the well. Furthermore, the cover will most preferably protect the window glass from unintentional impacts. A further object of the invention is to improve performance, by providing better techniques to secure the cover to both well and building, and also providing a more durable and environmentally resistant cover. Yet another objective is to improve the aesthetic appearance of the area well.

BRIEF DESCRIPTION OF THE DRAWINGS

Other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
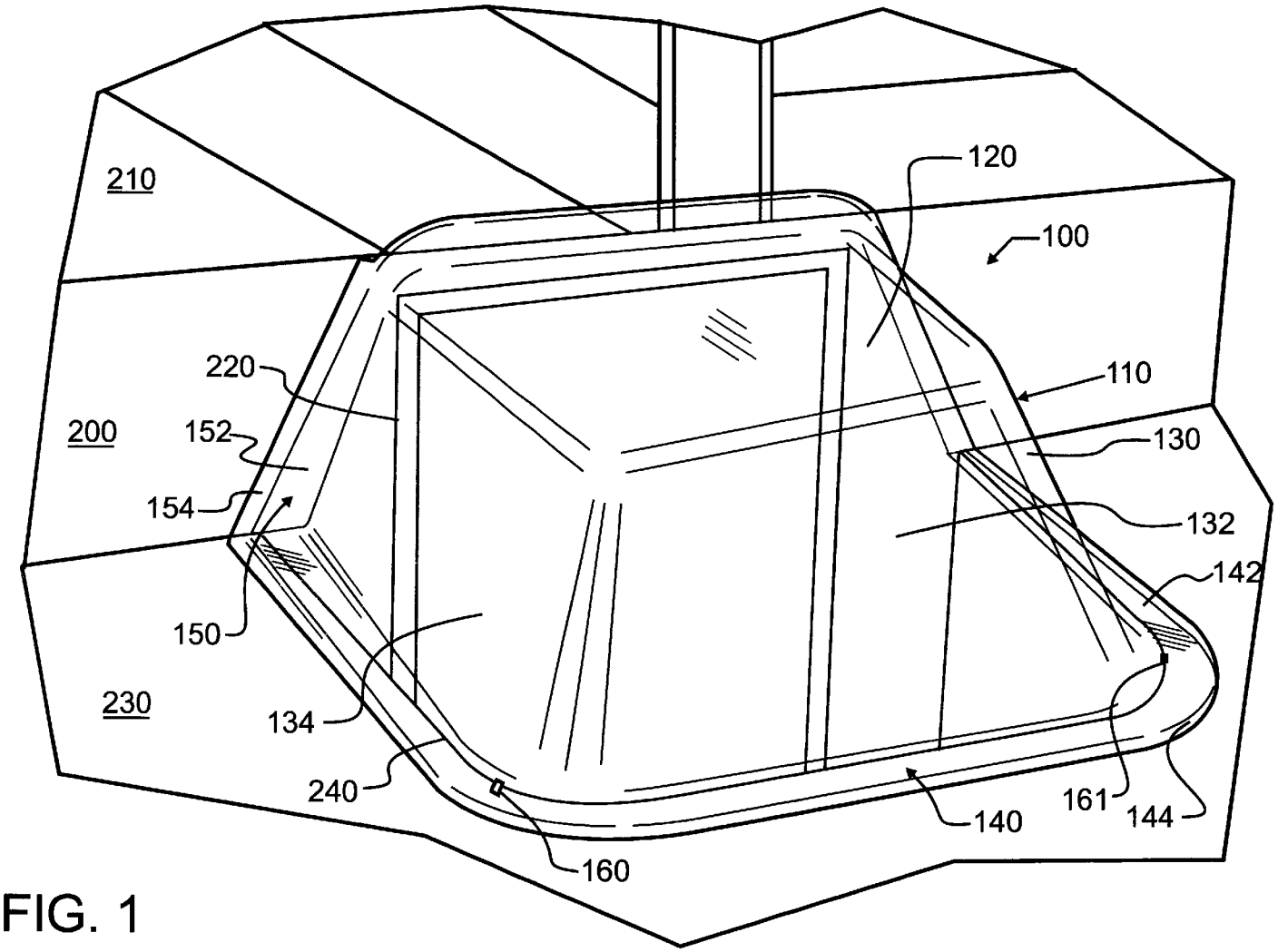
FIG. 1 illustrates a typical preferred embodiment cover and installation.

The preferred embodiment area well cover 100 is designed for application over standard sized wells, which presently come in sizes such as 42",50", 67", and the like. Cover 100 is most preferably slightly resilient, to accommodate dimensions that deviate slightly from the standard dimensions as will be further understood herein below. Domed or elevated body member 110 comprises the majority of surface area, and is designed to allow standard casement window 220 to operate freely when cover 100 is in operative position as shown in FIG. 1. Consequently, in the event of an emergency, an occupant may fully open casement window 220 and then enter into the well area defined by well wall 240, cover 100 and building foundation 200. Furthermore, using the preferred embodiment cover 100, the orientation of hinges on casement window 220 such as whether the hinges are left or right handed is irrelevant.

Body member 110 includes top body member 120, which is generally trapezoidal in shape. While generally planar in preferred embodiment cover 100, top body member 120 will most preferably be slightly domed from the edges to the center. This slight dome shape ensures drainage of moisture rather than pooling or puddling, and also adds to the total load bearing capability of top body member 120. In addition to being slightly domed, top body member 120 will most preferably exhibit a slight or gentle slope away from foundation 200, to help direct moisture away from siding 210 and foundation 200.

Supporting top body member 120 are sides 130, 132, 134, each which extend in a generally vertical direction. Sides 130 and 134 have a trapezium geometry, while side 134 has the shape of a trapezoid. The exact slope of each side is not critical to the invention, though a steep slope is preferred to reduce the total amount of material required in the fabrication of cover 100, while still accommodating a casement window 220 which extends higher than the top of area well wall 240. Nevertheless, some amount of angle from vertical is most preferred, since, in practice, area well wall 240 will not always be the same shape from one installation to the next. This is due to the fact that most standard well wall material is somewhat flexible, and is frequently bent differently from one installation to the next. Consequently, it is very desirable for cover 100 to follow the variations in different wells, to simplify installation thereto. The slight angle from vertical in sides 130, 132, 134 allows cover 100 to be flexed to align directly above area well wall 240. In addition to the adaptability to different well wall 240 geometries, the slight angle from vertical also helps to place body member 110 in compression when a load is placed on top member 120. Once again, this tends to increase the load bearing capacity of cover 100.

At the periphery of body member 110 and adjacent foundation 200 and siding 210 there is a building attachment structure 150 including a flat-mount flange 152 and modifiable wall accommodating flange 154. Most preferably, flat-mount flange 152 runs in a plane approximately parallel to the surface of foundation 200 and siding 210. In the most preferred embodiment, modifiable wall accommodating flange 154 is perpendicular or normal thereto, thought the exact angle is not critical. Rather the substantial change in direction between the two flanges offers several distinct benefits. In an application where the egress features of window 220 are not desired, flange 154 may be completely removed and flange 152 may be directly fastened to foundation 200. While this is not the preferred method of installation, those skilled in the art will recognize that the present invention offers the flexibility of installation similar to that found in the prior art, where covers are fastened directly to building surfaces through flanges that are parallel to the building surface. Nevertheless, this type of prior art installation does not allow window 220 to serve as an egress or escape window, and so in the present invention this method of attachment is not most preferred. Instead, in most instances and as shown in the figures, modifiable wall accommodating flange 154 will extend against foundation 200 and siding 210. The benefit of using a flange angled or specifically not coplanar with foundation 200 is the ability to trim flange 154 to follow the contours of the building surface. This will be explained in more detail with reference to FIG. 3 herein below. The combination of flanges 152 and 154 serve to broaden the installation options available. Another less apparent benefit is also obtained. The significant angular deviation between top 120 and sides 130, 134 with respect to flange 152, and the similarly significant angular deviation between flange 152 and flange 154 forms a structural reinforcement as well. Consequently, and without additional support or anchoring to foundation 200 or siding 210, top body member 120 will support a tremendous amount of weight. Without the dual flange arrangement of building attachment structure 150, top body member 120 would not be able to support nearly as much weight.

At the periphery of body member 110 and adjacent area well wall 240, there is also a dual flange arrangement that forms well attachment structure 140. This combination of dual flanges, similar to building attachment structure 150, provides substantial reinforcement to cover 100. In addition, base flange 142 is wide enough to accommodate small variations in different area well walls 240. Where the variations are too great, and as noted herein above, it is also possible for an installer to flex cover 100 to either increase or decrease the distance between sides 130 and 134 adjacent area well wall 240 to fit. A second drip flange 144 is provided which ensures moisture coming from body member 110 is directed to the ground 230 outside of area well wall 240, and is not able to wrap at the edge through surface tension phenomenon and drip into the area window well.

Figure 2:
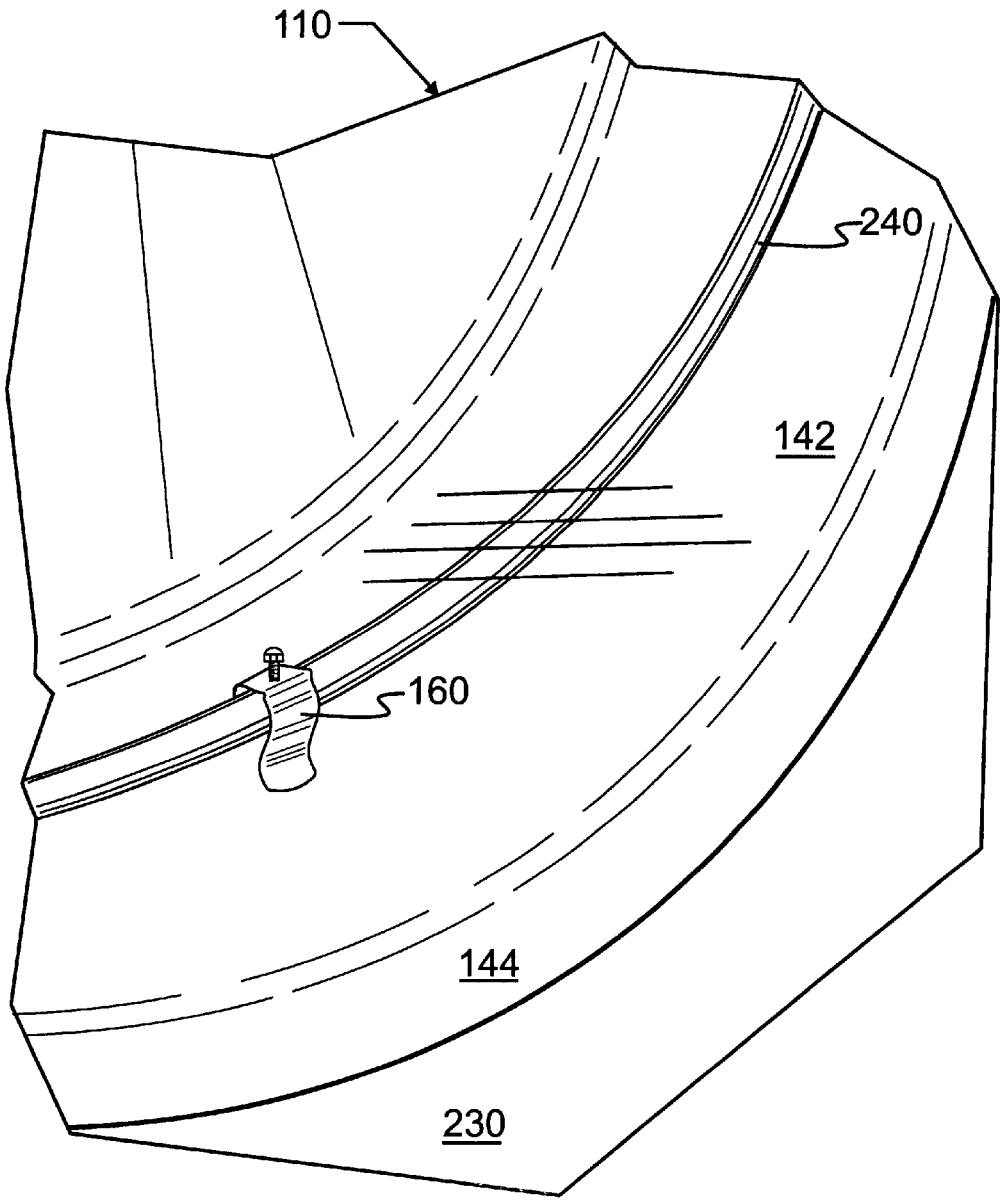
FIG. 2 illustrates the inner locking lower flange of the preferred cover of FIG. 1 including the outward drip rail.

The preferred area well cover 100, in addition to well attachment structure 140 which rests on the top of the area well wall 240, is also positively retained to wall 240 with one or more adjustable spring clips, such as clips 160, 161. Clip 160 along with well attachment structure 140 is shown in greater detail in FIG. 2. Most preferably, clips 160, 161 are located on opposing sides of well attachment structure 140, as visible in FIG. 1, where the clips are mounted adjacent the corners of base flange 142 away from the building structure. Clips 160, 161 most preferably have a means of detaching from the area well or structure, to allow cover 100 to be removed and re-installed readily. The exact number of clips and placement is not critical to the invention, and it will be apparent that none, one or a plurality may be employed. Most preferably, clips 160, 161 are placed in the corner regions as illustrated in FIG. 1, between adjacent sides. This particular location provides significant benefit in anchoring the cover and reducing movement when external forces are applied to cover 100. The area well cover is removed for fire escape by applying a force that pushes cover 100 vertically, to thereby lift cover 100 off of window well wall 240. Where desired, cover 100 may be locked, for added security benefit. In such instance, clips 160, 161 may be locking clips.

Figure 3:
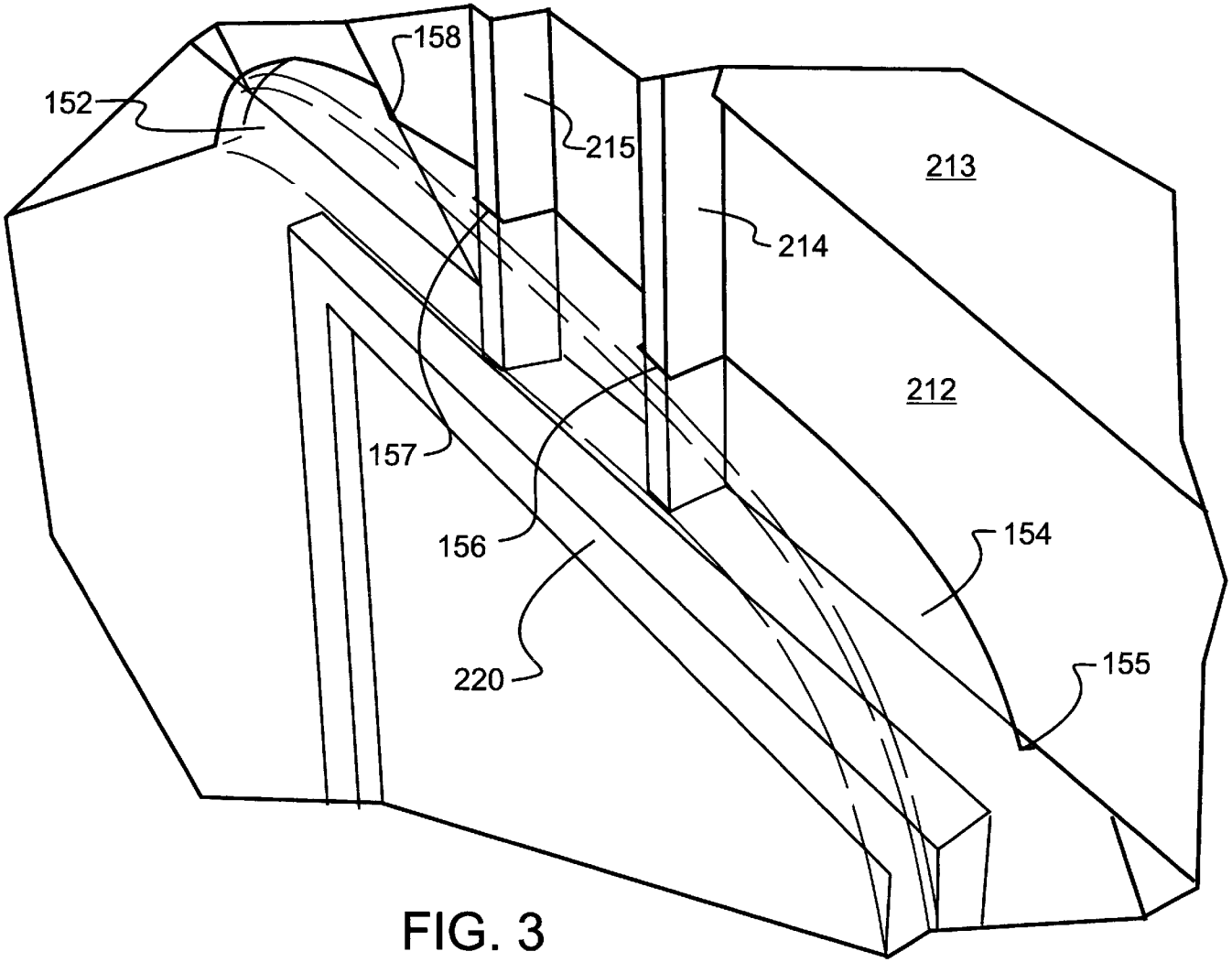
FIG. 3 illustrates the rear flange which is trimmed to accommodate irregularities in adjacent structures.

FIG. 3 illustrates in much greater detail the possible intricate accommodation which is available between cover 100 and a building wall structure such as siding 210. As can be seen therein, siding 210 includes laps 212, 213, but also includes vertical boards 214, 215 which protrude a great distance from laps 212, 213. In the prior art designs, there was no way to accommodate for the diversity of such a surface. In the present invention, wall accommodating flange 154 may have several cuts 155–158 therein which allow cover 100 to tightly conform to building siding 210. This ensures that cover 100 encloses the area window well completely regardless of the nature of siding 210 or foundation 200.

The method for enclosing an area window well adjacent a building surface includes the steps of determining standard window well dimensions that are most closely associated with the area window well. This may be done during design or layout of blueprints for new construction, or may be taken from measurements of the area window well in the case of a retrofit cover. Once the area well size is known, the size of cover may be determined as well. Either prior to the fabrication or design of the well, in the case of mass production, or subsequent thereto, an area window well cover is formed having a dome 110, a first flange 152 and a second flange 154 to fit the standard window well dimension. Next, second flange 154 is trimmed to fit area window well cover 100 to the adjacent building surfaces 200, 210, such that area window well cover 100 will operatively fully enclose the area window well. At some point during the installation, but typically after the trimming step, a retaining clip 160 will be attached to area window well cover 100. This will typically be done by drilling one or more holes through well attachment structure 140, followed by inserting one or more clips 160 through the one or more holes. If the clips are attached through threaded nut, these nuts will need to be placed and tightened. Once the one or more clips 160 are in place, they are coupled with area window well wall 240. Whether before or after the placing of clips, the trimmed second flange 154 will need engaged with the building surfaces 200, 210. Once cover 100 is in place, an installer will most preferably open and close the casement window 220 within the area window well subsequent to the coupling and engaging steps, to ensure clearance between casement window 220 and area window well cover 100.

Most preferably, the step of forming comprises vacuum thermoforming, though as aforementioned, other techniques may be used for forming. The step of trimming may also include entirely removing the second flange 154, and in that case the step of engaging will comprise affixing the first flange 152 to the building surfaces 200, 210.

In addition to being slightly resilient, the material used to fabricate area well cover 100 will most preferably be crystal clear and exhibit a high surface gloss. Cover 100 can also be colored, translucent or opaque, and may have a matted or other finish. A most preferred material for manufacture is ultraviolet (UV) resistant polycarbonate plastic, which provides high impact strength, good tolerance of hot or cold temperatures, electrical insulation which is not impaired by moisture, and resistance to high energy radiation. This plastic is also self-extinguishing after being removed from an ignition source. Other equivalent materials with similar characteristics and physical properties would be acceptable as well, and some materials which only exhibit some of the characteristics may be acceptable for specific applications, though these materials will be somewhat less preferred due to their more limited application. The manner or process in which the cover is manufactured is not critical to the invention, and may include injection molding, vacuum thermoforming, rotation or rotomolding, blow molding, or other molding or shaping processes. Vacuum thermoforming is most preferred however, owing to the lower cost of fabrication and relatively high throughput which may be obtained. The present preferred embodiment cover 100 is designed in consideration of thermoforming, and as will be apparent from a review of the present drawing figures, there are no curves or geometries that would interfere with removal from a vacuum mold. Consequently, the preferred construction is not only beneficial in performance, but may also be manufactured in volume easily.

The preferred embodiment area well cover designed in accord with the invention enhances safety while maintaining complementary shape with the absence of structural ribbing. The convex reinforced dome is achieved by forming round inverted and protruding corners, as can be seen in the figures. A variety of different shapes and sizes of this invention are conceived. The most preferred application is an area well cover, stationary or removable. The preferred embodiment provides an escape route, while also preventing people, animals, debris, snow, rain, toys etc. from falling into the area well. Nevertheless, and as aforementioned, the present invention also accommodates fixed or more permanent mounting to buildings where this is preferred, only necessitating the removal of flange 154 in such an instance. The preferred embodiment also complies with State Building Corporation uniform building code, to meet legal requirements.

While the foregoing details what is felt to be the preferred embodiment of the invention, no material limitations to the scope of the claimed invention are intended. Further, features and design alternatives that would be obvious to one of ordinary skill in the art are considered to be incorporated herein. Consequently, the scope of the invention is set forth and particularly described in the claims hereinbelow.

We claim:

1. In combination, a vertically extensive building exterior wall, an area window well adjacent to said building exterior wall, and an area window well cover for enclosing a generally horizontal top opening of said area window well located adjacent said vertically extensive building exterior wall and which accommodates a diverse variety of building exterior wall surfaces and geometries including flat, smooth regular walls and also including irregular surfaces that are not flat and smooth, said area window well cover comprising:

a body member which when placed in operative position extends generally across said top opening of said area window well;

a wall flat-mount flange extending at an angle from said body member in a plane generally parallel to said vertically extensive building exterior wall; and a modifiable wall accommodating flange extending between said wall mount flange and said vertically extensive building exterior wall primarily in a direction different from said wall flat-mount flange plane and generally at an angle relative to said vertically extensive building exterior wall and which is operatively modified to accommodate said diverse variety of building exterior wall surfaces and thereby fully enclose said area window well.

2. The combination vertically extensive building exterior wall, area window well, and area window well cover of claim 1 further comprising an area well support member adjacent said body member and extending generally horizontally from said body member in an operative position adjacent said top opening of said area well.

3. The combination vertically extensive building exterior wall, area window well, and area window well cover of claim 1 further comprising at least one releasable clip which removably retains said area window well cover to said area window well.

4. The combination vertically extensive building exterior wall, area window well, and area window well cover of claim 2 further comprising at least one releasable clip passing through said area well support member and which removably retains said area window well cover to said area window well.

5. The combination vertically extensive building exterior wall, area window well, and area window well cover of claim 2 further comprising an area well enclosing flange adjacent said area well support member and extending generally vertically about said top opening of said area window well.

6. The combination vertically extensive building exterior wall, area window well, and area window well cover of claim 1 wherein said modifiable wall accommodating flange extends normal to said wall flat-mount flange plane.

7. The combination vertically extensive building exterior wall, area window well, and area window well cover of claim 1 wherein said body member in an operative position further comprises a body top gently sloping away from said vertically extensive building in a primarily horizontal and substantially planar direction, first and second side walls each extending generally vertically from a first and a second edge of said top opening of said area window well and slightly converging from a plane normal to said generally vertically extending building, and a third side wall extending between said first and second side walls and also between said body top and said top opening of said area window well, said third side sloped substantially more than said body top.

8. The combination vertically extensive building exterior wall, area window well, and area window well cover of claim 1 wherein said area window well cover is further comprised of a formed polymeric material.

9. The combination vertically extensive building exterior wall, area window well, and area window well cover of claim 8 wherein said formed polymeric material further comprises polycarbonate plastic.

10. An area window well cover, for enclosing a top opening of an area window well located adjacent a building exterior wall, and which allows a generally planar casement window, having a window top that extends above a top of said area well, to rotate from a closed position to an open egress position underneath said area well cover when said area window well cover encloses said area window well, comprising:

a modifiable flange having a modifiable flange first edge existing in a generally vertical plane and defining a first portion of a border of said area window well cover and a modifiable flange second edge horizontally displaced from said modifiable flange first edge, said modifiable flange extending generally from said modifiable flange first edge to said modifiable flange second edge;

a second flange having a second flange first edge in contact with said modifiable flange second edge and extending in a generally vertical plane, and having a second flange second edge in contact with a top body member, a first side body member and a second side body member, said top, first side and second side body members extending horizontally away from said second flange in a direction opposed to a direction of said horizontal displacement from said modifiable flange second edge to said modifiable flange first edge;

a base flange existing in a generally horizontal plane and operative to engage an upper rim of an area window well;

said top body member extending primarily horizontally from said second flange with a gentle slope therefrom;

said first side body member adjacent to said second flange, also adjacent to a first edge of said top body member and additionally adjacent to said base flange, thereby forming a generally vertically extending substantially planar surface;

said second side body member adjacent to said second flange, also adjacent to said base flange, and additionally adjacent to a second edge of said top body member that is distal to said first edge of said top body member, thereby forming a generally vertically extending substantially planar surface; and a third side body member adjacent said top body member, said first and second side body members and said base flange, thereby forming a generally vertically extending substantially planar surface.

11. The area window well cover of claim 10 further comprising at least one releasable clip.

12. The area window well cover of claim 10 wherein said top body member further comprises a slight dome sufficient to ensure water sheds therefrom during operation.

13. The area window well cover of claim 10 wherein said top body member further comprises a trapezoid, said first and second side body members each comprise a trapezium, and said third side body member comprises a trapezoid.

14. An area window well cover which is both strong and resistant to collapse over large area wells, while preserving accessibility there through when installed in association with casement windows that extend above said large area wells, comprising:

a rim operative to engage with a vertical rim of said large area wells;

a body member rising above and covering an area circumscribed by said rim;

a reinforcing member extending from said body member generally normal to a surface defined by said rim;

a building wall engaging member extending from said reinforcing member in a direction generally normal to a surface of said reinforcing member and opposed to a direction said body member generally extends from said reinforcing member;

said rim, body member reinforcing member and building wall engaging member each formed from different portions of a single contiguous plastic sheet;

wherein said reinforcing member cooperates with said body member and said building wall engaging member to reinforce against vertically applied forces.

15. The area window well cover of claim 14, wherein said rim extends in a generally horizontal plane.

16. The area window well cover of claim 14 wherein said body member is domed.

* * * * *